US008618413B2

(12) United States Patent
Catchpole et al.

(10) Patent No.: US 8,618,413 B2
(45) Date of Patent: Dec. 31, 2013

(54) POWER CABLE

(75) Inventors: Jonathan Catchpole, Oxfordshire (GB); David John Porter, Wiltshire (GB); Stewart Toplis, Wiltshire (GB)

(73) Assignee: Tyco Electronics UK Ltd., Swindon, Wiltshire (GB)

( * ) Notice: Subject to any disclaimer, the term of this patent is extended or adjusted under 35 U.S.C. 154(b) by 96 days.

(21) Appl. No.: 12/736,683

(22) PCT Filed: Apr. 2, 2009

(86) PCT No.: PCT/GB2009/050324

§ 371 (c)(1), (2), (4) Date: Oct. 29, 2010

(87) PCT Pub. No.: WO2009/133381

PCT Pub. Date: Nov. 5, 2009

(65) Prior Publication Data

US 2011/0048768 A1 Mar. 3, 2011

(30) Foreign Application Priority Data

Apr. 29, 2008 (GB) ..... 0807741.1

(51) Int. Cl.
*H01B 7/00* (2006.01)

(52) U.S. Cl.
USPC ..... 174/36

(58) Field of Classification Search
USPC ..... 174/110 R, 110 SR, 120 R, 120 AR, 174/113 R, 112
See application file for complete search history.

(56) References Cited

U.S. PATENT DOCUMENTS

| | | | | |
|---|---|---|---|---|
| 535,084 | A * | 3/1895 | Still et al. | 174/27 |
| 3,706,955 | A | 12/1972 | Bunnell | |
| 5,228,160 | A * | 7/1993 | Porper | 7/158 |
| 5,847,622 | A * | 12/1998 | Chen | 332/103 |
| 6,374,126 | B1 * | 4/2002 | MacDonald et al. | 455/569.1 |
| 6,444,915 | B1 * | 9/2002 | Wang | 174/110 R |
| 6,909,050 | B1 * | 6/2005 | Bradford | 174/110 R |
| 7,507,908 | B1 * | 3/2009 | Wu et al. | 174/110 R |

FOREIGN PATENT DOCUMENTS

| | | | | |
|---|---|---|---|---|
| DE | 38 00 569 | A * | 4/1989 | F16L 11/12 |
| DE | 38 00 569 | C1 | 4/1989 | |
| DE | 10 2007 044502 | A1 | 3/2009 | |

OTHER PUBLICATIONS

International Search Report for PCT/GB2009/050324 issued by the European Patent Office on Jul. 24, 2009.

Written Opinion of the International Searching Authority for PCT/GB2009/050324, issued by the European Patent Office, Rijswijk, NL, Jul. 24, 2009; 5 pages.

International Preliminary Report on Patentability for PCT/GB2009/050324, issued by The International Bueau of WIPO, Geneva, Switzerland, dated Nov. 2, 2010; 6 pages.

* cited by examiner

*Primary Examiner* — William H Mayo, III
(74) *Attorney, Agent, or Firm* — Faegre Baker Daniels LLP

(57) ABSTRACT

A power cable (10) has a metal conductor encased in a first outer sheath (11), and further encased, partially along the length of the cable, in a second outer sheath (12, 13, 14) which influences the pattern of deformation of the cable under mechanical stress.

18 Claims, 1 Drawing Sheet

POWER CABLE

FIELD OF INVENTION

This invention relates to a power cable.

SUMMARY OF INVENTION

In accordance with the present invention, there is provided a power cable comprising a metal conductor encased in a first outer sheath, and further encased, partially along the length of the cable, in a second outer sheath which influences the pattern of deformation of the cable under mechanical stress.

The first and second outer sheaths may be heat shrink tubing.

The second outer sheath may be located in the middle of the cable, at both ends of the cable or, in three distinct sections, in the middle and at both ends of the cable.

BRIEF DESCRIPTION OF DRAWINGS

The invention will now be described, by way of example only, with reference to the following figures in which.

DETAILED DESCRIPTION

Figure 1A:
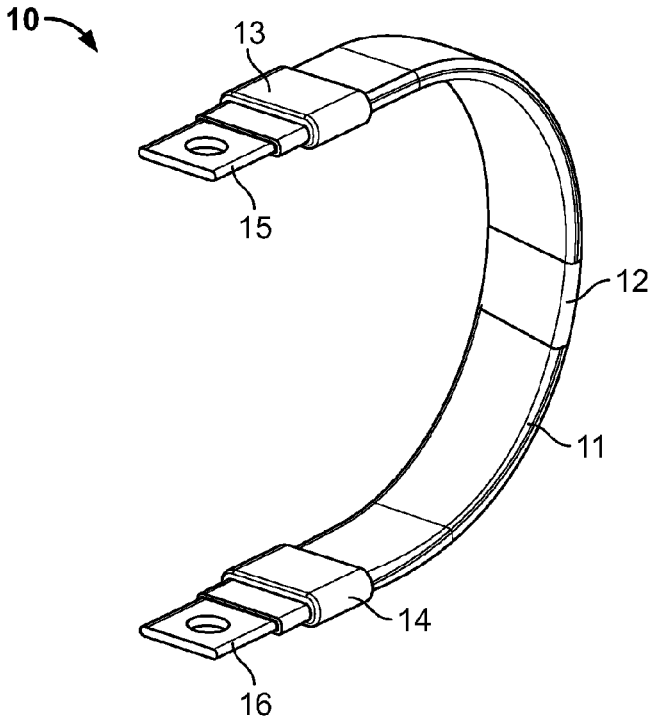
FIGS. 1*a* and 1*b* are 3-D and plan views respectively of a high voltage, high power jumper cable according to the present invention.
Figure 1B:
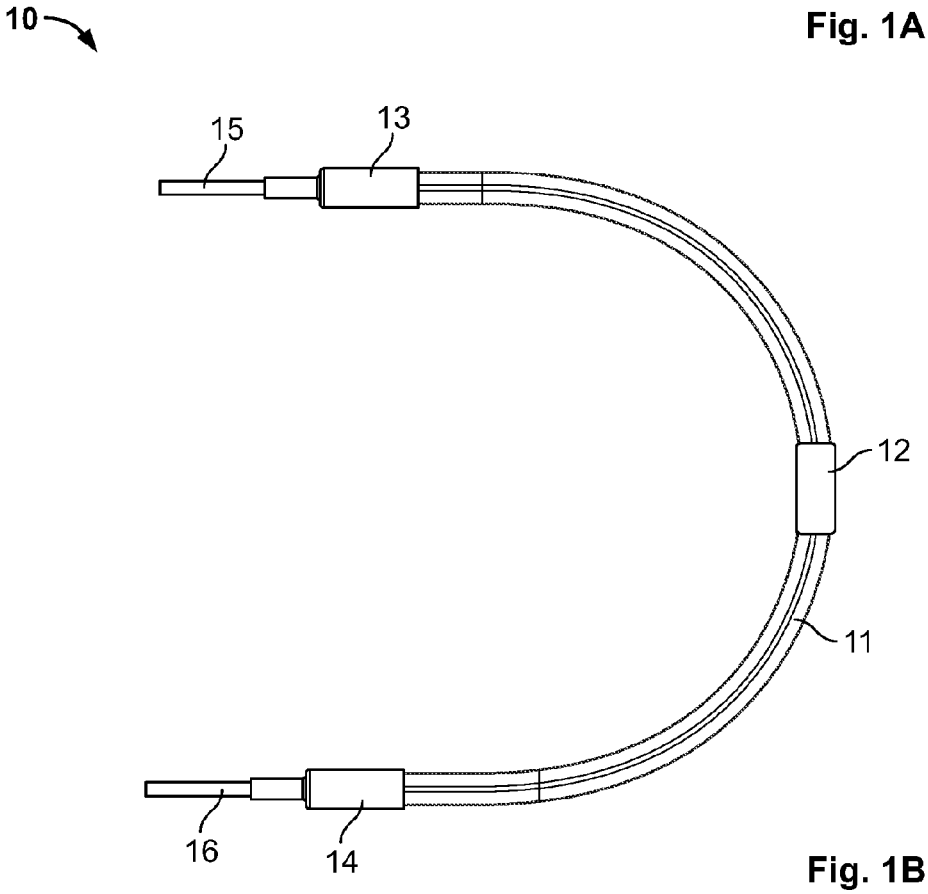

Referring to FIGS. 1*a* and 1*b*, a jumper cable 10 is shown comprising two terminals 15, 16 connected by a conducting tin coated, copper braid (not shown) which is entirely encases in a first layer of heat shrink tubing 11.

In accordance with the present invention, a second layer of heat shrink tubing 12, 13, 14 is applied over the first layer of heat shrink tubing in three locations; a first part 12 at the centre of the conducting cable, and second 13 and third 14 parts adjacent the terminals 15, 16.

In use, the second layer of heat shrink tubing 12, 13, 14 provides additional support of the conducting braid, and the selective application of the second layer of heat shrink tubing on the first layer of heat shrink tubing 11 influences the pattern of deformation of the cable 10 under mechanical. I.e. there is less deformation in such regions.

Although the embodiment description provides the second layer of heat shrink tubing 12, 13, 14 in three locations of the jumper cable 10, other configurations are contemplated.

The invention claimed is:

1. A power cable comprising a metal conductor encased in a first outer sheath, and further encased, partially along the length of the cable, in a second outer sheath encasing the first outer sheath which influences the pattern of deformation of the cable under mechanical stress, wherein at least one of the first outer sheath and the second outer sheath is a heat shrink material.

2. A cable according to claim 1, wherein the first outer sheath is heat shrink tubing.

3. A cable according to claim 1, wherein the second outer sheath is heat shrink tubing.

4. A cable according to claim 1, wherein the second outer sheath is located in the middle of the cable.

5. A cable according to claim 1, wherein the second outer sheath is located at both ends of the cable.

6. A cable according to claim 1, wherein the second outer sheath is located in three distinct sections in the middle and at both ends of the cable.

7. A power cable, comprising:

a conductor;

a first layer encasing the conductor; and a second layer encasing a plurality of portions of the first layer and decreasing deformation to the power cable in the plurality of portions.

8. The power cable of claim 7, wherein at least one of the first layer and the second layer is comprised of a heat shrink material.

9. The power cable of claim 7, further comprising a first terminal coupled to the conductor and a second terminal coupled to the conductor, wherein the second layer is comprised of a first end portion positioned adjacent the first terminal, a second end portion positioned adjacent the second terminal, and a center portion intermediate the first and second end portions.

10. The power cable of claim 9, wherein the first layer further extends continuously between the first and second terminals.

11. The power cable of claim 7, wherein a length of the second layer is less than a length of the first layer.

12. A power cable, comprising:

a conductor having a first end and a second end;

a first terminal at the first end of the conductor;

a second terminal at the second end of the conductor, the conductor having a length extending between the first and second terminals;

a first layer adjacent the conductor and continuous along the length of the conductor; and a second layer selectively coupled to the first layer to reduce deformation of the power cable under mechanical stress in the region of the second layer.

13. The power cable of claim 12, wherein the first layer is intermediate the conductor and the second layer.

14. The power cable of claim 12, wherein a length of the second layer is less than a length of the first layer.

15. The power cable of claim 14, wherein the second layer decreases the deformation of the power cable under mechanical stress.

16. The power cable of claim 12, wherein the second layer is comprised of at least three portions.

17. The power cable of claim 16, wherein a first portion of the second layer is adjacent the first terminal, a second portion of the second layer is adjacent the second terminal, and a third portion of the second layer is positioned approximately at a center portion of the power cable.

18. The power cable of claim 12, wherein at least one of the first layer and the second layer is comprised of a heat shrink material.

* * * * *